United States Patent [19]

Wasmer

[11] 4,375,794

[45] Mar. 8, 1983

[54] EXTERNAL INDUCTIVE SOLID STATE IGNITION SYSTEM

[75] Inventor: Anthony E. Wasmer, New Holstein, Wis.

[73] Assignee: Tecumseh Products Company, Tecumseh, Mich.

[21] Appl. No.: 211,283

[22] Filed: Nov. 28, 1980

[51] Int. Cl.[3] ..... F02P 1/08

[52] U.S. Cl. ..... 123/149 C; 123/652; 310/70 A; 315/218

[58] Field of Search ..... 123/149 C, 149 D, 149 R, 123/651, 652; 315/209 T, 209 SC, 218; 310/70 A; 307/252 C; 322/91

[56] References Cited

U.S. PATENT DOCUMENTS

| | | | |
|---|---|---|---|
| 3,405,347 | 10/1968 | Swift et al. | 322/91 |
| 3,484,677 | 12/1969 | Piteo | 123/651 |
| 3,958,546 | 5/1976 | Ohki et al. | 123/652 |
| 4,090,488 | 5/1978 | Ohki et al. | 123/651 |
| 4,120,277 | 10/1978 | Ehlen | 123/149 D |
| 4,188,930 | 2/1980 | Santi | 123/149 C |
| 4,207,852 | 6/1980 | Ohki et al. | 123/149 C |
| 4,270,509 | 6/1981 | Tharman | 123/647 |

*Primary Examiner*—Charles J. Myhre

*Assistant Examiner*—Andrew M. Dolinar

*Attorney, Agent, or Firm*—Albert L. Jeffers; Roger M. Rickert

[57] ABSTRACT

An ignition system of the contactless interrupt type for an internal combustion engine is disclosed with a control circuit including a pair of solid state semiconductor devices with one connected to the other in a controlling relation. The ignition system has a high voltage transformer with a secondary winding coupled to a spark plug and a primary winding shunted by the controlled one of the pair of semiconductors. A current flow is induced in the primary winding and then interrupted near its maximum value by rendering both of the semiconductor devices nonconducting. The controlling semiconductor may be a gate controlled switch or so-called gate turn-off device while the controlled semiconductor may be a power transistor. The primary winding current flow is induced by movement of a flywheel supported permanent magnet past the high voltage transformer while the current interrupt feature includes a control coil coupled to the controlling semiconductor and positioned close to the high voltage transformer to be influenced by the permanent magnet motion.

4 Claims, 2 Drawing Figures

EXTERNAL INDUCTIVE SOLID STATE IGNITION SYSTEM

BACKGROUND OF THE INVENTION

The present invention relates generally to internal combustion engine ignition systems and more particularly to such a system of the contactless interrupt type.

Many present day ignition systems, including for example the conventional automobile ignition system, employ breaker points to interrupt the current flow in a spark coil primary thereby introducing a high spark-creating voltage in a secondary winding of that spark coil which is coupled either directly or by way of a distributor to a spark plug to provide the spark for igniting fuel to drive the engine. Such breaker points are susceptible to dirt, moisture, wear of the cam actuating arrangement, and point erosion due to arcing so as to require the point gap to be reset frequently and the contact points to be periodically replaced. Further, such systems employ a relatively large number of mechanical parts which are both costly and time consuming in original manufacture, as well as subsequent maintenance.

Numerous attempts have been made to eliminate the cam actuated breaker points and their attendant problems with these attempts generally being in the direction of providing all electronic ignition systems.

One frequently encountered type of electronic ignition system is the so-called capacitor discharge ignition wherein a charge is accumulated on a capacitor and then at the appropriate time electronic switching occurs to discharge the capacitor through the primary winding of a spark coil or high voltage transformer thereby providing the desired ignition spark from the transformer secondary winding.

Contactless interrupt type ignition systems represent another direction in which attempts at providing all electronic ignitions have progressed. Here, the current in the primary winding of a spark coil is interrupted as in the conventional breaker point type ignition, however, the interruption of that current flow is provided by an electronic switching arrangement. With this type system the storage capacitor with its potential for failure is eliminated, however, accurate timing and rapid interruption of the primary winding current flow have remained troublesome problems. Also in many of these systems the magnitude of the high voltage output is undesirably dependent upon engine speed.

SUMMARY OF THE INVENTION

Among the several objects of the present invention may be noted the provision of a contactless interrupt type ignition system of adequate and relatively uniform output throughout a wide range of engine speeds with respect to timing and output voltage which provides sufficient voltage at low cranking speeds to start an engine; the provision of an ignition system which is easily fabricated; the provision of an ignition system of improved reliability; the provision of an ignition system which eliminates the mechanical contacts characteristic of many interrupt type ignition systems; the provision of an ignition system requiring reduced time and personnel in its assembly; the provision of a contactless interrupt type ignition system having minimized turn-off time so as to maximize the time rate of change of magnetic flux within a spark coil; and the provision of a contactless interrupt ignition system employing a reduced number of components. These as well as other objects and advantageous features of the present invention will be in part apparent and in part pointed out hereinafter.

In general, an ignition system for an internal combustion engine includes a spark coil with primary and secondary windings and at least one spark plug connected to the secondary winding along with an arrangement for providing a magnetic field in the primary winding which varies in synchronism with rotation of the internal combustion engine and a control arrangement for interrupting current flow in the spark coil primary when that current flow is near a maximum to induce a spark creating voltage in the secondary winding. The control arrangement includes a power transistor with its collector-emitter circuit connected across the spark coil primary winding and under the control of a gate controlled switch. A control coil is positioned in close proximity to the spark coil and influenced by the magnetic field to interrupt the primary winding current by disabling the gate controlled switch and therefore also the transistor.

Also in general and in one form of the invention, first and second solid state semiconductor devices are connected with one controlling the other and with the other shunting the primary winding of a high voltage transformer. A current flow is induced in the primary winding and then interrupted by rendering both the semiconductor devices nonconducting.

BRIEF DESCRIPTION OF THE DRAWING

Corresponding reference characters indicate corresponding parts throughout the several views of the drawing.

Figure 1:
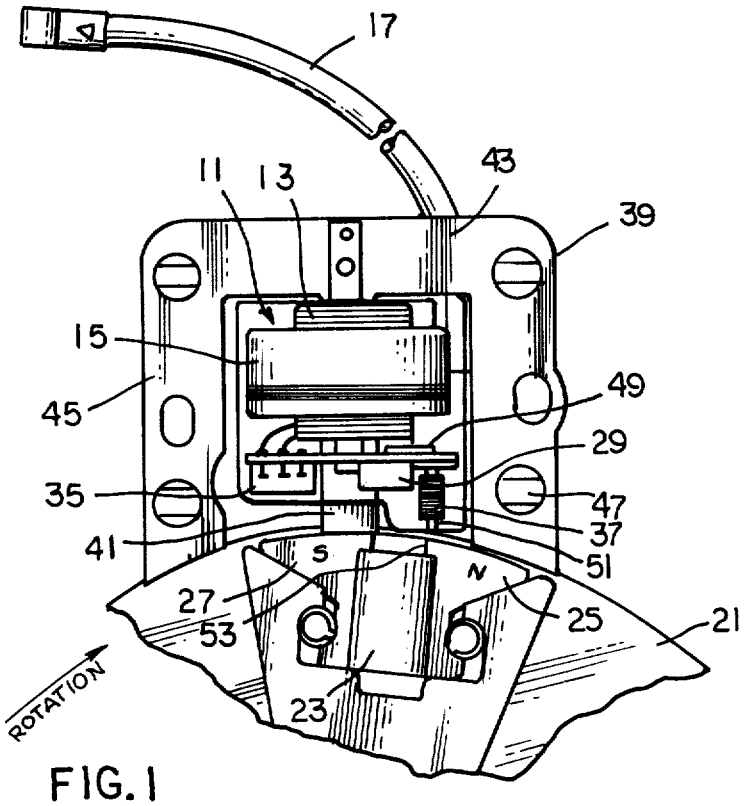
FIG. 1 is a plan view of an ignition system stator and a portion of an internal combustion engine flywheel with a peripherally disposed permanent magnet.
Figure 2:
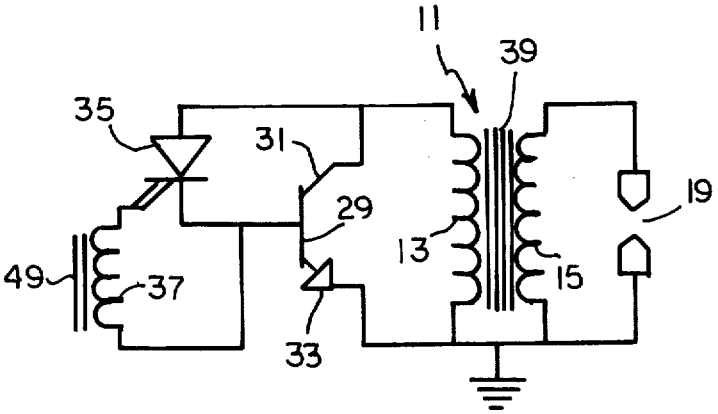
FIG. 2 is a schematic diagram of the circuitry of the ignition system of FIG. 1.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Referring to the drawing generally, the internal combustion engine ignition system is seen to include a spark coil 11 having a primary winding 13 and a secondary winding 15 with the secondary winding 15 connected by way of a spark plug lead wire 17 to a spark plug depicted schematically as gap 19. An engine crankshaft driven flywheel 21 has a high retentivity permanent magnet 23 peripherally positioned thereon to pass closely adjacent the spark coil during flywheel rotation. This permanent magnet is poled in the tangential direction so as to provide a permanent north pole in iron pole shoe 25 and a permanent south pole in the iron pole shoe 27. The flywheel is otherwise fabricated from a nonmagnetic material such as cast aluminum and may include a counterbalancing weight diametrically opposite the permanent magnet 23. This permanent magnet flywheel structure provides a magnetic field in the primary winding 13 which changes in synchronism with rotation of the flywheel.

The control circuit is seen to include a power transistor 29 having collector 31 and emitter 33 connected across, in a shunting manner, the primary winding 13. This power transistor is connected in a controlled manner to a gate controlled switch 35 which is in turn controlled by a control coil 37.

Control coil 37 is located in close proximity to the spark coil 11 as opposed to, for example, being located within the flywheel structure or circumferentially displaced from the spark coil and is influenced by the permanent magnet passage during the same time interval that the spark coil is being influenced by that magnetic field. Specifically, control coil 37 provides a signal to the gate controlled switch 35 to turn that switch off, interrupting the base current supply to transistor 29 and therefore also disabling the transistor to interrupt primary winding current flow through transistor 29 and induce a spark creating voltage in the secondary winding 15 to be supplied to the spark plug gap 19. Control coil 37 is located relative to the spark coil and the poles 25 and 27 so as to interrupt the primary current winding near the time that the current reaches a maximum value. The interruption at that time creates a high time rate of change of flux within the magnetic core 39 so that a very high voltage output is obtained.

The primary and secondary windings 13 and 15 are generally concentrically positioned as at 11 in FIG. 1 on the center leg 41 of a generally E-shaped laminated magnetic core 39 with the base of the E identified as 43 and the opposed end legs of the E identified as 45 and 47. The trigger coil 37 core 49 may be a generally L-shaped core of relatively few laminations with the downwardly depending leg thereof supporting the control coil 37 lying adjacent and generally parallel to the center leg 41 of the E-shaped core. This control or trigger coil core 49 may have several possible locations with respect to core 39 being determined by which edge of which of the poles 25 and 27 are selected for turning the gate controlled switch 35 on and off. In the illustrated location of control coil 37, the magnetic flux path for both the primary winding magnetic field and the control coil includes at least a part of the center leg 41 and end leg 45 when the flow of primary winding current is initiated and that flux path includes at least a part of the center leg 41 and the other end leg 47 of the E-shaped core when the primary winding current is interrupted.

In operation, with the flywheel turning in a clockwise direction, as indicated by the arrow, when the leading edge of north pole 25 reaches the tip end 51 of the control coil core, a signal from that control coil enables gate turn off device 35 into its conducting state. At this time the primary flux path for both the control coil 37 and the high voltage transformer 11 is through the left end leg 45 of the E-shaped core by way of base 43 and center leg 41 of the E-shaped core. Also at this time, the flux in the center leg 41 is diminishing. At a later time when the trailing edge 53 of the north pole 25 passes the end 51 of the trigger coil core 49, coil 37 is effected to turn off gate controlled switch 35. At this time, current flow through transistor 29 is near its maximum value and this abrupt interruption in the base drive current to transistor 29 rapidly changes that transistor to is non-conducting state, producing a very abrupt change in the flux in magnetic core 39 and the desired induced high voltage in secondary winding 15.

In an exemplary ignition system control coil 37 was formed from 2,300 turns of No. 44 wire while primary coil 13 was formed from 335 turns of No. 26 wire and the secondary coil was formed of 9,350 turns of No. 44 wire. Power transistor 29 was a type MJE13005 Motorola transistor while the gate turn-off device or gate controlled switch was an RCA No. G7100. This last component is of course a bistable solid state semiconductor device which is gate controlled and differs from the conventional transistor in that once the gate is triggered, there is no requirement for a sustaining current through that gate to maintain the device in its conductive state. The device is very similar to the more frequently encountered silicon controlled rectifier, however, with the gate controlled switch, the option of turning the device off by a reverse gate current typically on the order of 30 to 50% of the main current through the device is available. With the conventional silicon controlled rectifier, turn off occurs only when the current flow ceases typically due to a reversal in the polarity of the voltage across the device.

From the foregoing it is now apparent that a novel ignition system has been disclosed meeting the objects and advantageous features set out hereinbefore as well as others and that modifications as to the precise configurations, shapes and details may be made by those having ordinary skill in the art without departing from the spirit of the invention or the scope thereof as set out by the claims which follow.

What is claimed is:

1. In an internal combustion engine ignition system of the type having a generally E-shaped magnetic core, a spark coil with primary and secondary windings positioned on the center leg of the generally E-shaped magnetic core, at least one spark plug connected to the secondary winding, means for providing a magnetic field in the magnetic core for inducing a current flow in the primary winding, the magnetic field changing in synchronism with rotation of a part of the internal combustion engine, an improved ignition control circuit of the contactless interrupt type comprising:

a control circuit consisting of a control coil, a power transistor having a collector-emitter circuit connected across the primary winding, and a gate controlled switch connected in controlling relation to the transistor;

said control coil being in close proximity to the spark coil generally intermediate a pair of the E-shaped core legs and influenced by the means for providing a magnetic field to interrupt the magnetic field induced current in the primary winding near the time that current reaches a maximum value by disabling the gate controlled switch and therefore also the transistor and induce a spark creating voltage in the secondary winding.

2. The improvement of claim 1 wherein a collector-emitter circuit of the transistor is substantially the sole primary winding current path outside the primary winding.

3. The ignition system of claim 1 wherein the means for providing a magnetic field includes a flywheel supported permanent magnet positioned to pass closely adjacent the spark coil during flywheel rotation.

4. The ignition system of claim 1 further comprising a generally L-shaped control coil core with one leg thereof adapted to support the control coil and to lie adjacent and generally parallel to the center leg of the E-shaped core.

* * * * *